US009986627B2

(12) United States Patent
Barty

(10) Patent No.: US 9,986,627 B2
(45) Date of Patent: May 29, 2018

(54) METHOD FOR EFFICIENT, NARROW-BANDWIDTH, LASER COMPTON X-RAY AND GAMMA-RAY SOURCES

(71) Applicant: Lawrence Livermore National Security, LLC, Livermore, CA (US)

(72) Inventor: Christopher P. J. Barty, Hayward, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days. days.

(21) Appl. No.: 15/635,119

(22) Filed: Jun. 27, 2017

(65) Prior Publication Data

US 2017/0347439 A1 Nov. 30, 2017

Related U.S. Application Data

(63) Continuation of application No. 14/274,348, filed on May 9, 2014, now Pat. No. 9,706,631.

(60) Provisional application No. 61/990,637, filed on May 8, 2014, provisional application No. 61/990,642, filed on May 8, 2014, provisional application No. 61/821,813, filed on May 10, 2013.

(51) Int. Cl.
*H05G 2/00* (2006.01)

(52) U.S. Cl.
CPC ..... *H05G 2/00* (2013.01)

(58) Field of Classification Search
CPC ..... H05G 2/00
See application file for complete search history.

(56) References Cited

U.S. PATENT DOCUMENTS

| | | | |
|---|---|---|---|
| 3,780,294 | A | 12/1973 | Sowerby |
| 4,598,415 | A | 7/1986 | Luccio et al. |
| 5,040,200 | A | 8/1991 | Ettinger et al. |
| 5,115,459 | A | 5/1992 | Bertozzi |
| 5,247,562 | A | 9/1993 | Steinback |
| 5,293,414 | A | 3/1994 | Ettinger et al. |
| 5,323,004 | A | 6/1994 | Ettinger et al. |
| 5,353,291 | A | 10/1994 | Sprangle et al. |
| 5,420,905 | A | 5/1995 | Bertozzi |
| 5,847,863 | A | 12/1998 | Galvanauskas et al. |
| 6,035,015 | A | 3/2000 | Ruth et al. |

(Continued)

FOREIGN PATENT DOCUMENTS

| | | |
|---|---|---|
| WO | 2005081017 | 1/2005 |
| WO | 2007038527 | 4/2007 |

(Continued)

OTHER PUBLICATIONS

Boucher, S., et al., "Inverse compton scattering gamma ray source", Nuclear Instruments and Methods in Physics Research, A 608, 2008, pp. S54-S56.

(Continued)

*Primary Examiner* — Dani Fox
(74) *Attorney, Agent, or Firm* — John P. Wooldridge

(57) ABSTRACT

A method of x-ray and gamma-ray generation via laser Compton scattering uses the interaction of a specially-formatted, highly modulated, long duration, laser pulse with a high-frequency train of high-brightness electron bunches to both create narrow bandwidth x-ray and gamma-ray sources and significantly increase the laser to Compton photon conversion efficiency.

24 Claims, 4 Drawing Sheets

(56) References Cited

U.S. PATENT DOCUMENTS

| | | | | |
|---|---|---|---|---|
| 6,442,233 | B1 | 8/2002 | Grodzins et al. | |
| 6,661,818 | B1 | 12/2003 | Feldman et al. | |
| 6,684,010 | B1 | 1/2004 | Morris et al. | |
| 6,687,333 | B2 | 2/2004 | Carroll et al. | |
| 7,060,983 | B2 | 6/2006 | Turner | |
| 7,120,226 | B2 | 10/2006 | Ledoux et al. | |
| 7,277,526 | B2 | 10/2007 | Riftkin et al. | |
| 7,391,850 | B2 | 6/2008 | Kaertner et al. | |
| 7,564,241 | B2 | 7/2009 | Barty et al. | |
| 7,596,208 | B2 | 9/2009 | Rifkin et al. | |
| 7,693,262 | B2 | 4/2010 | Bertozzi et al. | |
| 8,369,480 | B2 | 2/2013 | Barty | |
| 8,934,608 | B2 | 1/2015 | Barty | |
| 2004/0109532 | A1 | 6/2004 | Ford | |
| 2004/0240037 | A1 | 12/2004 | Harter | |
| 2005/0179911 | A1 | 8/2005 | Boomgarden et al. | |
| 2005/0226278 | A1 | 10/2005 | Gu et al. | |
| 2006/0166144 | A1 | 7/2006 | Te Kolste et al. | |
| 2006/0188060 | A1 | 8/2006 | Bertozzi et al. | |
| 2006/0193433 | A1 | 8/2006 | Ledoux et al. | |
| 2006/0251217 | A1 | 11/2006 | Kaetner et al. | |
| 2007/0177640 | A1 | 8/2007 | Liu | |
| 2007/0263767 | A1 | 11/2007 | Brondo, Jr. | |
| 2009/0147920 | A1 | 6/2009 | Barty et al. | |
| 2011/0007760 | A1 | 1/2011 | Clowes et al. | |
| 2012/0288065 | A1* | 11/2012 | Graves | H05G 2/00 378/119 |

FOREIGN PATENT DOCUMENTS

| | | |
|---|---|---|
| WO | 2009086503 | 7/2009 |
| WO | 2009097052 | 8/2009 |
| WO | 2011071563 | 6/2011 |

OTHER PUBLICATIONS

Gibson, D.J., et al., "Design and operation of a tunable MeV-level Compton-scattering-based x-ray source", The Americal Physical Society, Physical Review and Special Topics—Accelerators and Beams, 13, 2010, 12 p.

Hagmann, C.A., et al., "Transmission-based detection of nuclides with nuclear resonance fluorescence using a quasimonoenergetic photon source", J. Appl. Phys., vol. 106, 2009, pp. 1-7.

Jovanovic, I, et al., "High-power picosecond pulse recirculation for inverse compton scattering", Nuclear Physics B, 184, 2008, pp. 289-294.

Shverdin, M.Y., et al., "High-power picosecond laser pulse recirculation", Optics Letters, vol. 35, No. 13, 2010, pp. 2224-2226.

Zamfir, N.V., et al., "Extreme light infrastructure: nuclear physics", Proc. of SPIE, vol. 8080, pp. 1-8.

International Search Report and Written Opinion for PCT/US12/054872 related to U.S. Appl. No. 14/343,706, 9 pages.

International Search Report and Written Opinion for PCT/US12/047483 related to U.S. Appl. No. 13/552,610, 9 pages.

* cited by examiner

METHOD FOR EFFICIENT, NARROW-BANDWIDTH, LASER COMPTON X-RAY AND GAMMA-RAY SOURCES

CROSS-REFERENCE TO RELATED APPLICATIONS

This is a continuation of U.S. patent application Ser. No. 14/274,348 titled "Modulated Method for Efficient, Narrow-bandwidth, Laser Compton X-ray and Gamma-ray Sources," filed May 9, 2014, which claims the benefit of U.S. Provisional Patent Application No. 61/821,813 titled "Modulated, Long-Pulse Method for Efficient, Narrow-Bandwidth, Laser Compton X-Ray and Gamma-Ray Sources," filed May 10, 2013, incorporated herein by reference and further claims the benefit of U.S. Provisional application 61/990,637, titled "Ultralow-Dose, Feedback Imaging System and Method Using Laser-Compton X-Ray or Gamma-Ray Source", filed May 8, 2014 and incorporated herein by reference and still further claims the benefit of U.S. Provisional application 61/990,642, titled "Two-Color Radiography System and Method with Laser-Compton X-Ray Sources", filed on May 8, 2014 and incorporated herein by reference.

STATEMENT REGARDING FEDERALLY SPONSORED RESEARCH OR DEVELOPMENT

The United States Government has rights in this invention pursuant to Contract No. DE-AC52-07NA27344 between the U.S. Department of Energy and Lawrence Livermore National Security, LLC, for the operation of Lawrence Livermore National Laboratory.

BACKGROUND OF THE INVENTION

Field of the Invention

The present invention relates to x-ray and gamma-ray generation and more particularly to x-ray and gamma-ray generation via laser Compton scattering.

Description of Related Art

Laser Compton scattering (sometimes also referred to as inverse Compton scattering) is the process in which an energetic laser pulse is scattered off of a short duration, bunch of relativistic electrons. This process has been recognized as a convenient method for production of short duration bursts of quasi-monoenergetic, x-ray and gamma-ray radiation. In the technique, the incident laser light induces a transverse dipole motion of the electron bunch which when observed in the rest frame of the laboratory appears to be a forwardly directed, Doppler upshifted beam of radiation. The spectrum of any laser Compton source extends from DC to 4 gamma squared times the energy of the incident laser photons for head on laser-electron collisions. (Gamma is the normalized energy of the electron beam, i.e., gamma=1 when electron energy=511 keV.)

By changing the energy of the electron bunch, beams of high energy radiation ranging from 10 keV x-rays to 20 MeV gamma-rays have been produced and used for a wide range of applications. The spectrum of the radiated Compton light is highly angle-correlated about the propagation direction of the electron beam with highest energy photons emitted only in the forward direction. With an appropriately designed aperture placed in the path of the x-ray or gamma-ray beam, one may create quasi-monoenergetic x-ray or gamma-ray pulses of light whose bandwidth (DE/E) is typically 10% or less. The present inventor has been particularly interested in the generation of narrow bandwidth (bandwidth of the order 0.1%) gamma-rays that may be used to excite isotope-specific nuclear resonances. Such beams of gamma-rays may be produced through optimized design of interaction of the laser and electron and with the use of high-quality laser and electron beams whose respective spectra are less than 0.1%.

One fundamental limitation of the laser Compton sources is the small cross section for laser and electron interactions. This cross section known as the Thomson cross section has a magnitude of only 6E-25 $cm^2$. The inverse of the Thomson cross section represents the number of photons required per unit area to achieve unity probability of scattering. For any appreciable probability of interaction, one requires both high photon and electron densities. Typically this is achieved by focusing both the electron and the laser pulse into the same small volume in space and time.

Referring now to the drawings, FIG. 1 illustrates the classical geometry for laser Compton scattering where a single high charge, electron bunch 10 interacts with a single, high energy, laser poise 12, both of approximately the same short time duration and both of approximately the same transverse size at the point of interaction. Note that the electron beam retains its minimum spot size over a greater distance than the laser pulse for the same minimum spot size. The figure illustrates the electron beam envelope 14, the laser beam envelope 16, the confocal region 18 of the laser focus, and Compton output light 20.

The laser pulse energy required to achieve unity efficiency (one scattered x-ray or gamma-ray per electron) scales as the square of the laser spot diameter. Smaller spots require less laser energy to create the same number of photons from the same charge electron bunch. Because the range over which the laser retains its smallest spot size (confocal parameter) scales as square of the spot size, the maximum duration of the laser pulse for which effective overlap with the electron bunch occurs also decreases in proportion to the square of the spot diameter. Because of the relativistic motion of the electron bunch, it is typical that the region over which the electron bunch retains its smallest transverse extent is greater than that of the laser pulse if both the electron beam and the laser beam are focused to same spot size. For diffraction-limited, green laser light, and practical spot sizes of order 10 microns radius, the required laser energy for 100% scattering efficiency (i.e., one scattered photon for each electron in the electron bunch) is ~1.8 J while the transit time of the laser pulse through the focal region is of order 5 ps. Typical narrow bandwidth systems operate with 1% to 10% scattering efficiency in order to avoid nonlinear broadening effects.

The time averaged output from laser Compton sources can be increased by increasing the number of electron bunches per unit time produced by the accelerator. In modern, room temperature accelerator systems it is possible to create a long train of electron bunches (so called micro-bunches) whose temporal spacing can be as small as the period of the RF frequency driving the accelerator. The maximum number of bunches in the micro-bunch train is set by the duration of the RF drive pulse for the accelerator and can be of order 1000. By reducing the charge in each micro-bunch, one may dramatically improve the quality of the electron bunch, i.e., its emittance, energy spread, focusability, etc., and thus improve the quality (bandwidth) of the Compton source. Multi-bunch operation can in principle create a higher flux x-ray or gamma-ray output if sufficient laser photons are available for interaction with all the electrons of the micro-bunch train.

One objective of co-pending U.S. application Ser. No. 13,552,610 titled "High Flux, Narrow Bandwidth Compton Light Sources Via Extended Laser-Electron Interactions," filed Jul. 19, 2011, incorporated by reference, which is by the same inventor, is to increase the focal spot size of the interaction laser spot to match the unfocused transverse dimension of the electron bunch. In this way, the transit time of the electrons through the laser focus is many RF periods. FIG. 2 illustrates asymmetric mode Compton scattering. The figure shows long pulse 30 interacting with many closely spaced electron bunches 32 as they traverse the interaction region. Notice also the shape of the laser pulse envelope 34 and the electron bunch envelope 36. Compton Light output 38 is also shown.

To first order, the interaction of the laser with the electron bunch does not perturb the energy of the laser pulse and each electron bunch sees the same laser field. Many electron bunches will interact with the same laser pulse. This method reduces bandwidth broadening effects due focusing of the laser and electron bunch, simplifies the interaction geometry since the electron beam does not need to be focused and greatly reduces the timing synchronization requirements between the long duration (nanoseconds) laser and the picosecond time-scale electron bunch. On the other hand increasing the laser spot size in the interaction region dramatically increases the laser energy required to produce the same number of x-ray or gamma-rays from a given electron bunch charge in proportion to the square of the spot size. This method also really only becomes practical for the highest frequency RF accelerators where the micro-bunch spacing is minimized, e.g., x-band (12 GHz or 83 ps bunch spacing), which is 4× the frequency of s-band (3 GHz or 333 ps bunch spacing) is much better suited to this geometry. In real use, the method is also limited by the ability to safely create large laser foci within the spatial constraints imposed by the accelerator, specifically by damage on the turning optics that direct the laser light into the interaction region.

SUMMARY OF THE INVENTION

Embodiments of the present invention provide methods for x-ray and gamma-ray generation via laser Compton scattering. Exemplary methods use the interaction of a specially-formatted, highly modulated, long duration, laser pulse with a high-frequency train of high-brightness electron bunches to both create narrow bandwidth x-ray and gamma-ray sources and to significantly increase the laser energy to Compton photon conversion efficiency.

Embodiments of the present invention have use in the generation of x-rays and gamma-rays, including the generation of mono-energetic (or quasi-mono energetic) gamma-rays. Applications of mono-energetic x-rays and mono-energetic gamma-rays include but are not limited to isotope-specific material detection, assay and imaging, medical radiography and medical radiology, industrial non-destructive evaluation of objects and materials, and high resolution x-ray imaging.

In an embodiment of the present invention, electron micro bunches are provided at the same radio frequency (RF) as the operating RF of the linear accelerator that provides the electron micro bunches which are propagated through a first confocal region within an interaction zone or region. Laser pulses are also provided at the RF and these pulses are directed to propagate within a second confocal region. The first confocal region and the second confocal region intersect in the interaction region such that the electron micro bunches collide with the laser pulses to generate x-rays or gamma-rays via laser Compton scattering. A key concept of the invention is that each single (individual) laser pulse collides with a single (individual) electron micro bunch in the interaction region. It is desirable that each single laser pulse of the laser pulses collides with a corresponding single electron micro bunch of the electron micro bunches in the interaction region in a manner such that to first order each electron bunch and laser pulse pair produces the same number of laser Compton photons. If other than the same number of laser Compton photons are produced, it is less desirable but as long as the system meets the requirements for production and interaction of the electron micro bunches and the laser pulses described above, such a system is within the scope of the present invention.

In the exemplary embodiments, the pulse duration of each laser pulse of the laser pulses is of the order of the transit time of each laser pulse through the second confocal region and further, that the pulse duration of each electron micro bunch of the electron micro bunches is of the order of the transit time of each laser pulse of the laser pulses through the second confocal region. It should be noted that a single laser system can be used to provide both the UV pulses that drive the electron gun of the linear accelerator and to provide the laser pulses to the interaction region. It should be further noted that a first laser system can be used to provide the UV pulses to the e-gun and a second laser system can be used to provide the pulses to the interaction region. Generally, each laser system consists of a CW IR laser that is modulated by an electro optical modulator which is driven by the same RF frequency that drives the linear accelerator. The bandwidth of the modulated IR beam is then broadened by self focusing system. The broadened beam is then amplified and its frequency is appropriately converted to the $3^{rd}$ harmonic in the case of the e-gun and to the second harmonic in the case of the interaction laser pulses. It is desirable that the interaction laser pulse spacing and the electron bunch spacing are matched. The electron micro bunches and the interaction laser pulses are made to collide either directly into one another (their directions are 180 degrees from one another), or the angle between the two beams can be about 90 degrees. In still another embodiment, the angle between the first confocal region and the second confocal region is less than 180 degrees such that the electron micro bunches miss the optic that focuses the laser pulses. The present invention includes the apparatuses and their combinations required to carry out the above described exemplary methods.

The present invention has further applications in some embodiments described in the provisional applications to which this case claims priority.

U.S. Provisional application 61/990,637, titled "Ultralow-Dose, Feedback Imaging System and Method Using Laser-Compton X-Ray or Gamma-Ray Source", filed May 8, 2014 by the same inventor as the present application and incorporated herein by reference represents a new method for ultralow-dose, x-ray or gamma-ray imaging based on fast, electronic control of the output of a laser-Compton x-ray or gamma-ray source (LCXS or LCGS). In this method, X-ray or gamma-ray shadowgraphs are constructed one (or a few) pixel(s) at a time by monitoring the LCXS or LCGS beam energy required at each pixel to achieve a threshold level of detectability. The beam energy required to reach the detection threshold is proportional to the inverse of the opacity of the object. The beam energy to reach threshold is determined simply by measuring the illumination time required by the constant power LCXS or LCGS to achieve threshold detectability at the detector. Once the threshold for detection is reached, an electronic or optical signal is sent to the LCXS/LCGS that enables a fast optical switch that in turn diverts either in space or time the laser pulses used to create Compton photons. In this way, one prevents the object from being exposed to any further Compton x-rays or gamma-rays until either the laser-Compton beam or the object are moved so that a new pixel location may be illumination. This method constructs the image of the object with the minimal possible x-ray or gamma-ray dose. An important aspect of this invention, is that this method of feedback control on the x-ray or gamma-ray source does not in any way perturb the steady state operation of the laser or accelerator subsystems of the LCXS/LCGS and thus the beam available for exposure at each imaging location is identical from pixel to pixel once the electronically activated switch is disabled. Another important aspect of this imaging system is that the dynamic range of the image is not constrained by the detector dynamic range but rather by the time one is willing to dwell at any one pixel. Embodiments of the present invention are useable as the laser-Compton X-ray and laser-Compton gamma-ray source in embodiments of the ultralow-dose, feedback imaging systems of U.S. Provisional application 61/990,637. It should be noted that other laser-Compton X-ray and laser-Compton gamma-ray sources than the ones taught in the present disclosure may be useable in the embodiments of this incorporated provisional.

U.S. Provisional application 61/990,642, titled "Two-Color Radiography System and Method with Laser-Compton X-Ray Sources", filed on May 8, 2014 by the same inventor as the present application and incorporated herein by reference present embodiments of new methods for creation of high-contrast, subtraction, x-ray images of an object via scanned illumination by a laser-Compton x-ray source. The invention of this provisional application utilizes the spectral-angle correlation of the laser-Compton scattering process and a specially designed aperture and/or detector to produce/record a narrow beam of x-rays whose spectral content consists of an on-axis region of high-energy x-rays surrounded by a region of slightly lower-energy x-rays. The end point energy of the laser-Compton source is set so that the high-energy x-ray region contains photons that are above the k-shell absorption edge (k-edge) of a specific contrast agent or specific material within the object to be imaged while the outer region consists of photons whose energy is below the k-edge of the same contrast agent or specific material. Illumination of the object by this beam will simultaneously record the above k-edge and below k-edge absorption response of the object for the regions illuminated by the respective portions of the beam. By either scanning the beam or scanning the object relative to the beam, one may build up the full above and below k-edge spatial response of the object. These spatial responses when properly-normalized and subtracted from one another create a map that is sensitive to the presence or absence of the specific contrast agent or special material within the object and as such the subtraction image represents a high-contrast radiograph of the presence of the contrast agent or special material within the object. The technique may be used for a variety of x-ray imaging tasks to either increase image contrast at a fixed x-ray dose to the object or to reduce the x-ray dose required to obtain an x-ray image of a desired contrast. Of particular note is that this method obtains both the above and below k-edge maps of the object without requiring any adjustment of the end-point energy of the x-ray source or any whole beam filtering of the x-ray source and can do so without illuminating the object with lower-energy, non-penetrating x-rays that are typically present from conventional rotating anode, x-ray sources. Possible applications include but are not limited to coronary angiography in which the blood is doped with iodine as a contrast agent and used to provide an image of arterial blockages or low-dose mammography in which the breast is injected with a gadolinium based contrast agent and used to image the vascularization associated with pre-cancerous material. In both cases, subtraction x-ray images of the contrast agents can provide vital information and do so with equivalent or better image quality and/or significantly lower dose than conventional x-ray radiography. Embodiments of the present invention are useable as the laser-Compton X-ray source in embodiments of the methods for 2-color radiography of U.S. Provisional application 61/990,642. It should be noted that other laser-Compton X-ray sources than the ones taught in the present disclosure may be useable in the embodiments of this incorporated provisional.

The present invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

In an exemplary method of the present invention, a new approach for x-ray and gamma-ray generation via laser Compton scattering is provided in which a specially formatted, long duration laser pulse, comprised of a train of equally spaced, short duration spikes, is used to interact efficiently with a long train of closely spaced electron micro-bunches. Embodiments cover both the multi-GHz pulse format of the overall interaction geometry and the methods for production of the high-energy, GHz, puked laser train that matches with sufficient precision the spacing of the electron pulses so as to produce nearly equal pulses of radiation from pulse to pulse. For purposes of this disclosure, the pulsed laser train and the spacing of the electron pulses are sufficiently matched if matched electron and laser pulses always meet at the interaction region.

Figure 1:
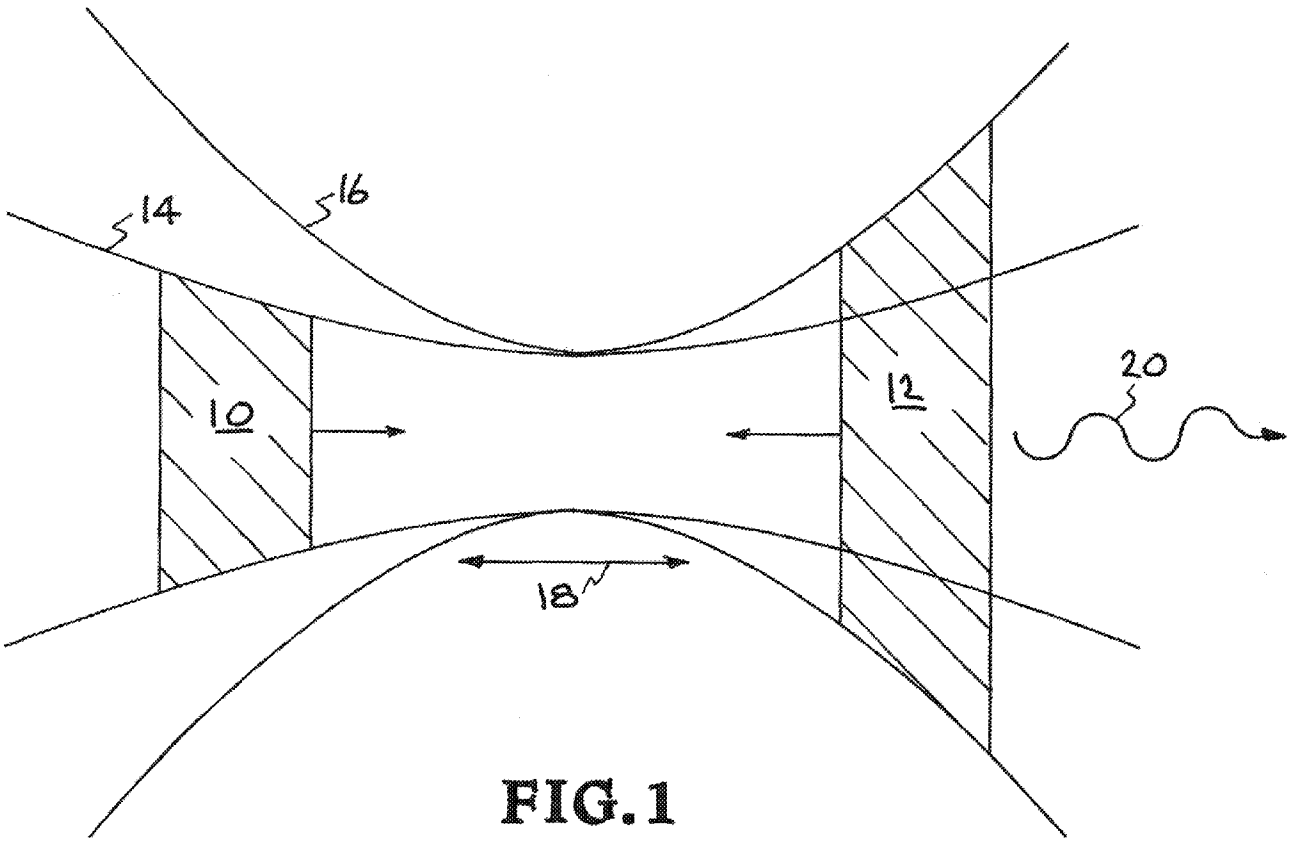
FIG. 1 illustrates a prior geometry for laser Compton scattering.
Figure 2:
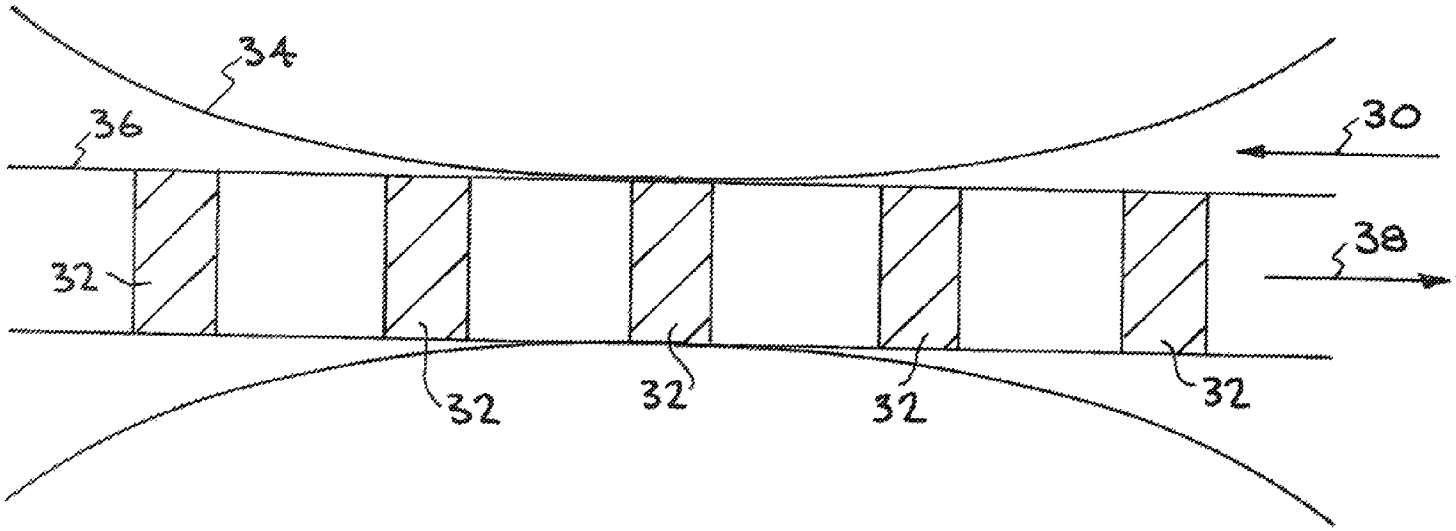
FIG. 2 illustrates asymmetric mode Compton scattering.
Figure 3:
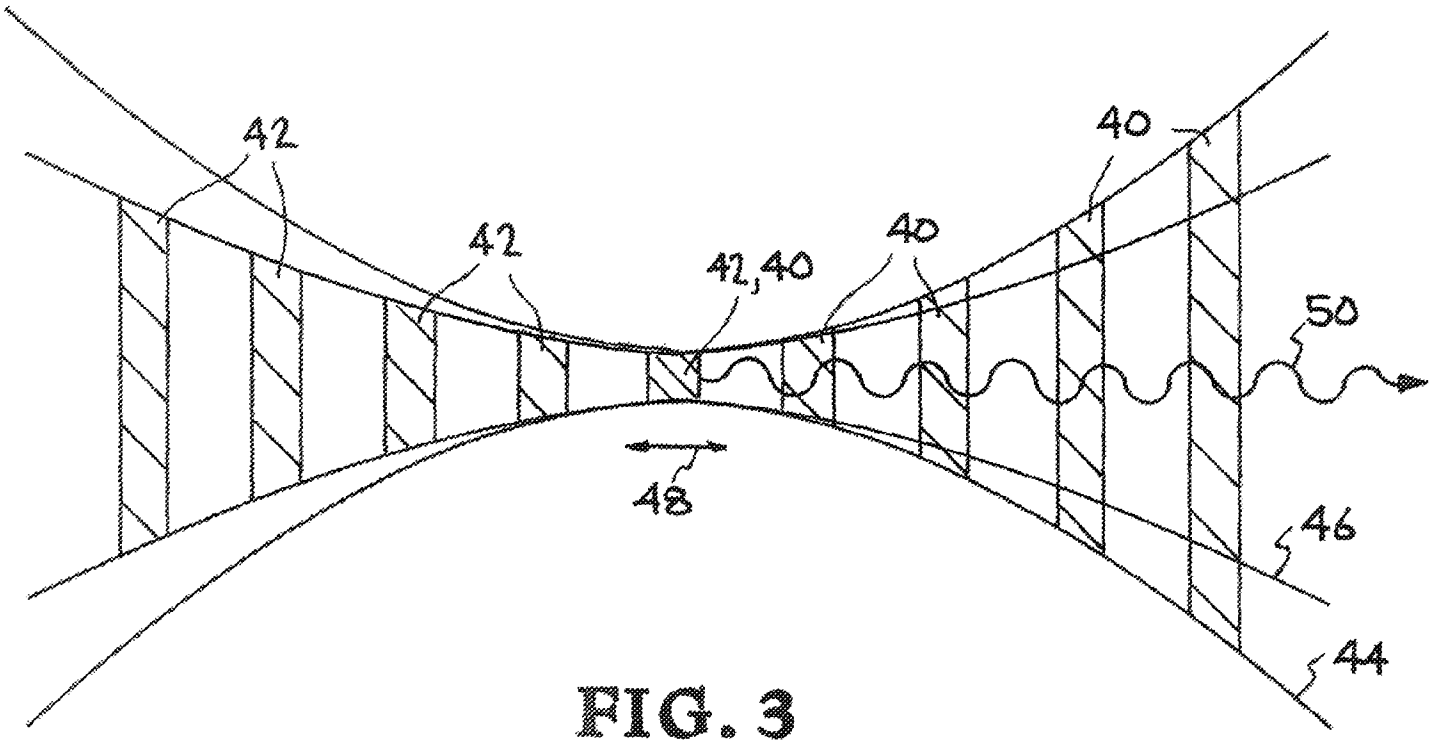
FIG. 3 illustrates that small spot dimension significantly increases the efficiency of the Compton interaction.

As illustrated in FIG. 3, in the present invention both the formatted laser pulses 40 and the electron bunches 42 of the electron beam are focused to small overlapping spots. The figure also illustrates the laser pulse envelope 44, the electron micro bunch envelope 46, the confocal region 48 and the Compton output light 50. For example, for a 10 micron radius focus, the transit time of a green laser pulse through the confocal parameter of the focus is ~3.9 ps. In practice the efficiency of the interaction will be roughly the same for laser pulses of twice this duration or less. The electron pulse duration should also be of the order of the laser confocal parameter transit time. This is again a reason for higher frequency RF systems. A 2.5 ps electron bunch duration is typical for the x-band and 10 ps is typical for the S band. A small spot dimension significantly increases the efficiency of the Compton interaction. For a formatted pulse with the same overall duration and energy as the long pulse suggested in the previous paragraph, the efficiency increase will be proportional to the ratio of the unformatted to formatted spot dimension squared, which can easily be more than 2 orders of magnitude.

The present invention provides a new approach for generation of x-rays and gamma-rays via laser Compton scattering in which a specially formatted, long duration laser pulse comprised of a train of equally spaced, short duration spikes is used to interact efficiently with a long train of closely spaced electron micro-bunches. Embodiments of the present invention cover both the multi-GHz pulse format of the overall interaction geometry and the methods for production of the high-energy, GHz, pulsed laser train that matches, with sufficient precision, the spacing of the electron pulses. Note that if the same train of laser pulses that are used to create the UV pulses that produce the electron bunches are also used to seed the laser amplifier, then the laser pulse spacing and the electron bunch spacing will be identical by design, i.e., they will be "exactly" matched. Note also that the laser pulse may be a long duration pulse or a series of short duration spikes only. The contrast between the laser pulses is important. The contrast between the laser pulses is important. In the embodiment considered, a train of chirped pulses would be amplified by the same long pulse laser used in the asymmetric geometry. A simple grating pair pulse compressor after the amplifier would then produce a train of short duration pulses. As long as a sufficient amount of the energy is in the pulses and not in a pedestal between the pulses, this idea will work.

As illustrated in FIG. 3, both the formatted laser pulse and the electron beam are focused to small overlapping spots. The small spot dimension significantly increases the efficiency of the Compton interaction. For a formatted pulse with the same overall duration and energy as the long pulse suggested in the previous paragraph, the efficiency increase will be proportional the ratio of the unformatted to formatted spot dimension squared, which can easily be more than 2 orders of magnitude.

As illustrated in FIG. 3, the optimum duration of the laser spikes or micro laser pulses is of order the transit time of the individual laser spike through the laser focal region. As also illustrated in FIG. 3, focusing to a small laser spot size, results in a larger laser spot at the final turning optic and dramatically reduces the possibility of causing damage to that optic. It should also be noted, that for high quality electron bunches and laser pulses, this interaction geometry will not be the dominant contribution to broadening the overall bandwidth of the output x-rays or gamma-rays. Furthermore for laser Compton scattering involving the second harmonic (or higher) of the fundamental laser frequency, this method provides a higher peak intensity in the frequency conversion media and consequently will have higher conversion efficiency than the equivalent energy and overall duration, non-modulated laser pulse.

One can create the appropriate formatted, high-energy, interaction laser pulse via adaptation of laser techniques that have recently been demonstrated to create frequency-locked, multi-GHz trains of micro-Joule laser pulses. Some embodiments of the present invention utilize or adapt laser techniques taught in International Application Number PCT/US12/54872, titled "Directly Driven Source of Multi-Gigahertz, Sub-Picosecond Optical Pulses", filed Sep. 12, 2012, incorporated herein by reference. International Application Number PCT/US12/54872 has been filed in the U.S. National stage as U.S. application Ser. No. 14/343,706, incorporated herein by reference. A purpose is to produce a RF-synchronized, train of sub-ps UV pulses to be used to illuminate the photo-cathode of a photo-gun to create a train of high-quality electron bunches. The accelerator RF frequency is used to drive a high frequency electro-optic modulator which modulates the intensity of an input infrared (typically 1 micron wavelength) CW laser to create a train of very low energy, laser pulses whose duration is of order half of the RF period and whose spacing is precisely (less than 1 part in 1000 of the RF frequency) the RF period. The duty cycle of this optical pulse train is of order 50%. By passing this train of pulses through an appropriate set of passive and active fiber optical components, one may increase the bandwidth of the individual pulses via self phase modulation, impose a linear frequency chirp on them due the dispersion of the fibers. Then by passing the chirped pulses through amplifier stages, their pulse energy is increased to the micro-Joule scale or above. After exiting the amplifier stages, the linear frequency chirp may be removed by an appropriate dispersive delay line, e.g., a parallel grating pair, and in the process create a train of sub-ps pulses that are synchronized with the RF frequency of the accelerator and may be frequency tripled with the appropriate non-linear optics to create the UV photons needed to liberate electrons from the photo-cathode of an accelerator photo-gun. The primary benefits of this approach are the inherent absolute synchronism with the RF frequency of the accelerator and the ability to produce sub-ps pulses at multiple GHz repetition rates, i.e., well beyond that of conventional mode-locked laser technology. Note that while this technique provides a straightforward method for precise synchronization, other methods to produce high frequency pulse trains would also work as long as the repetition rate of the pulses is closely enough matched to the accelerator RF to allow equal energy acceleration, i.e. of order 1 part in 1000 or better.

In some embodiments, the interaction laser pulse train is seeded by the same (or similar) infrared laser pulse train as used to create the UV photogun pulses. Because the interaction laser pulse train is effectively created via modulation by the accelerator RF, the spacing of the individual laser pulses is also locked exactly to the RF frequency and also to the frequency of the micro-bunches with which they will eventually interact. Optimal laser-electron interaction is achieved when the individual laser pulses and electron bunches arrive at the center of the common beam focus simultaneously. This can be assured via a simple, adjustable optical delay line, i.e., an optical trombone. A schematic of this arrangement is shown in FIG. 4.

Figure 4:
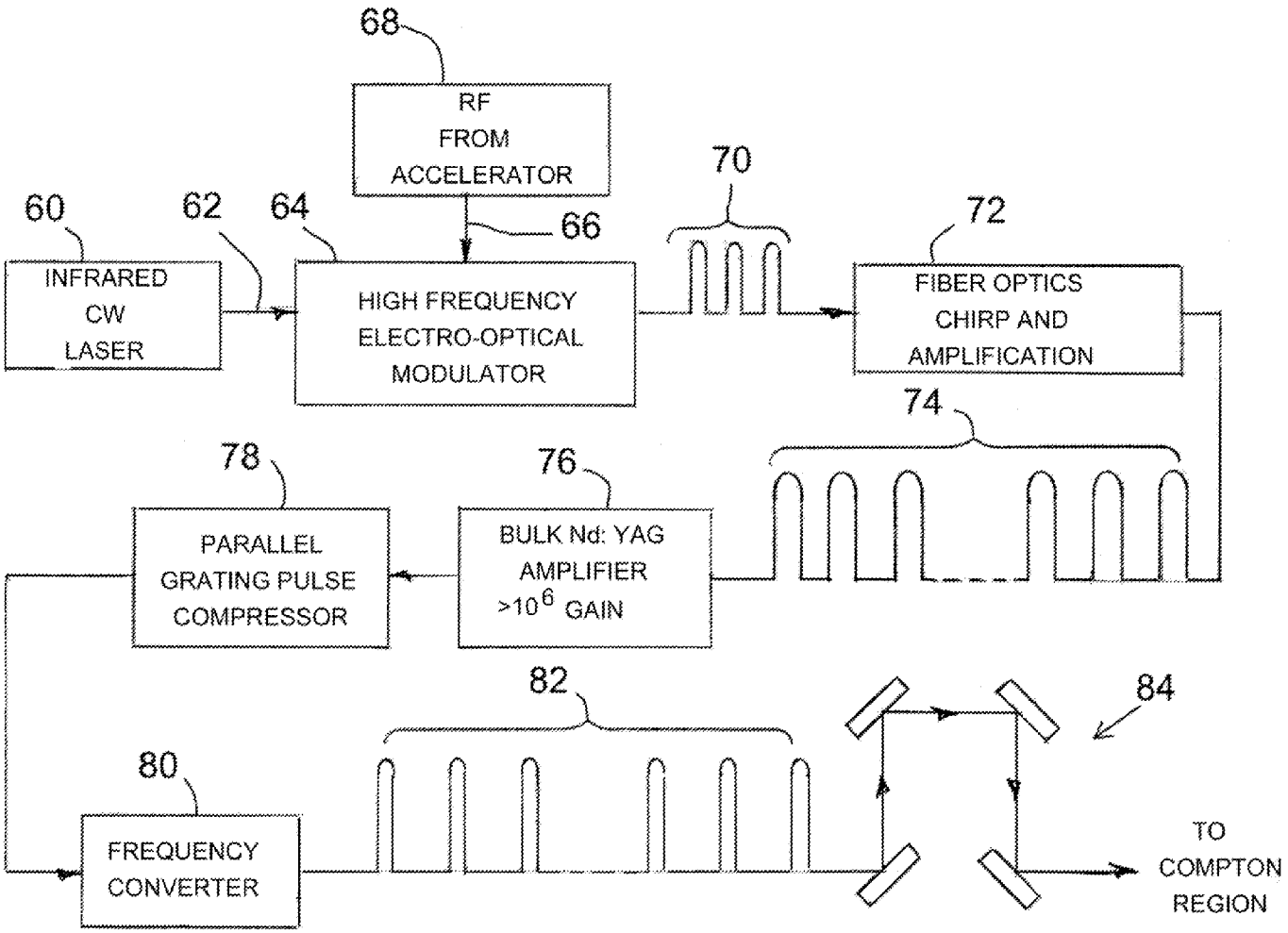
FIG. 4 illustrates that optimal laser-electron interaction is achieved when the individual laser pulses and electron bunches arrive at the center of the common beam focus simultaneously.

FIG. 4 shows an exemplary laser system useable to provide both the ultraviolet pulses for the accelerator electron gun and the laser pulses for interaction with the electron micro bunches in the interaction zone. As mentioned above, some embodiments of the present invention utilize or adapt laser techniques taught in International Application Number PCT/US12/54872, titled "Directly Driven Source of Multi-Gigahertz, Sub-Picosecond Optical Pulses", filed Sep. 12, 2012, incorporated herein by reference. International Application Number PCT/US12/54872 has been filed in the U.S. National stage as U.S. application Ser. No. 14/343,706, incorporated herein by reference. In some embodiments, a single laser system can be used to provide both the pulses to the electron gun and to the interaction zone. In other embodiments, a first laser system provides the UV pulses and a second laser system provides the laser pulses to the interaction zone. Referring to FIG. 4, an infrared (IR) CW laser 60 provides an IR laser beam 62 that is directed through a high frequency electro-optical modulator 64 having a radio-frequency (RF) modulation frequency 66 provided from a linear accelerator 68. A modulated IR beam 70 of pulses is output from modulator 64 and is directed through a fiber optic and chirp and amplification system 72 to provide a first amplified beam 74 of pulses. The fiber optic is used to provide self-phase modulation of beam 70. The first amplified beam 74 of pulses is then amplified by a bulk amplifier 76 and is then compressed by a parallel grating pulse compressor 78 before it its frequency is converted by frequency converter 80 to produce output beam 82. When used to produce UV pulses to drive the electron gun of the accelerator, the frequency converter consists of a first convertor to convert the IR beam to the second harmonic and a second convertor to convert the second harmonic beam to the third harmonic which is the UV light. When used to produce laser pulses to interact with the electron micro bunches in the interaction region, the frequency convertor consists of a single convertor to convert the IR beam to the second harmonic. The system may also include the so-called optical trombone 84, consisting of 4 mirrors, to alter the delay of the UV pulses to the electron gun and to alter the delay of the laser pulses to the interaction region. The present invention is not limited to the laser system shown in FIG. 4 or the systems described in the incorporated patent application. Based on the teachings herein, those skilled in the art will understand that other laser systems could be utilized in the present invention, provided that the requirements mention above that the electron bunches and the laser pulses interact as required by the present invention. What is important is that the UV energy is above the work function of the photo cathode of the electron gun so that electrons are liberated when illuminated by the UV light. While the example above uses the $2^{nd}$ harmonic of the IR laser light, the device will work if the IR alone is used for the interaction or if other harmonics or frequency conversion systems, e.g. optical parametric amplifiers, are used to modify the IR photons before interacting with the electron bunches.

The technique described above is compatible with interaction laser pulse recirculation in which the interaction laser is reused multiple times. See incorporated by reference U.S. application Ser. No. 13/552,601 for a discussion of exemplary methods and systems for interaction laser pulse recirculation. (The present invention is not limited to such methods however.) This recirculation can be accomplished by trapping the interaction laser pulse within a cavity that includes the interaction region. Trapping can be accomplished via nonlinear frequency conversion and dichroic optics, i.e., the RING (recirculation injection by non-linear gating) method, or more conveniently via a polarizer and electro-optic switch (Pockels cell) placed within the cavity. Trapping can also be accomplished by angularly multiplexing the beam. With a longer train of electron micro-bunches, recirculation can be used to increase the average flux of the Compton source. It should be noted that trapping via use of a bulk Pockels cell is not possible in traditional Compton configurations that use a single, high energy laser pulse to interact with high charge electron bunches. Transit through a Pockels cell by a high energy, short duration (fs or ps) laser pulse would result in pulse broadening on each transit and more importantly would likely result in damage of the Pockels cell or cavity optics because of self focusing of the laser pulse in the Pockels cell material. Both issues are effectively eliminated with the use of the formatted laser pulse of the present invention. For discussion of the RING technique, see I. Jovanovic, S. G. Anderson, S. M. Betts, C. Brown, D. J. Gibson, F. V. Hartemann, J. E. Hernandez, M. Johnson, D. P. McNabb, M. Messerly, J. Pruet, M. Y. Shverdin, A. M. Tremaine, C. W. Siders, and C. P. J. Barty, "High-energy picosecond laser pulse recirculation for Compton scattering," in *Particle Accelerator Conference,* 2007 *PAC IEEE* (Institute of Electrical and Electronics Engineers, Piscataway, N.J., 2007), pp. 1251-1253. (2007), incorporated herein by reference. See also Shverdin, M. Y., I. Jovanovic, V. A. Semenov, S. M. Betts, C. Brown, D. J. Gibson, R. M, Shuttlesworth, F. V. Hartemann, C. W. Siders and C. P. J. Barty. "High-power picosecond laser pulse recirculation." Optics Letters 35(13): 2224-2226, (2010), incorporated herein by reference.

Although not limiting, examples of some other variations of the present invention are listed below.

1) The seed pulse train is generated via RF modulation of a bulk CW laser. Bulk components, rather than fiber components, are used to create the chirp and to amplify the seed. Fiber components, however, are preferable as they are more robust for real world applications.

2) The individual pulses in the pulse train are compressed prior to amplification in the bulk laser. This eliminates the diffraction losses due to compression after the bulk amplifier and eliminates or minimizes the possibility for cross talk between the individual pulses during amplification. This mode of operation will however expose the bulk amplifier material to higher peak power pulses and may induce damage. Viability of this mode of operation will depend upon the nonlinear properties of the amplification media.

3) An interleaved pulse train is re-circulated in a cavity that has a round trip time of exactly one half of the total duration of the laser pulse train.

4) The system is operated with longer duration for the individual pulses in the laser pulse train. The duration of the individual pulses can be somewhat longer than the transit time of the interaction region and still be effective.

5) The same fiber front end can be used to produce both the photo-gun drive UV pulses and the seed for the interaction laser system. This generally is not done because the fiber systems tend to produce the shortest duration pulses at wavelengths outside of the gain bandwidth of bulk amplification media. Future modifications of the fiber systems may allow short pulse generation at appropriate wavelengths for bulk amplification in material such as Nd:YAG. It should be noted that the Nd:YAG amplifier will only support pulse band widths of a few ps and thus this approach if possible would not affect the bandwidth of the Compton source output.

The foregoing description of the invention has been presented for purposes of illustration and description and is not intended to be exhaustive or to limit the invention to the precise form disclosed. Many modifications and variations are possible in light of the above teaching. The embodiments disclosed were meant only to explain the principles of the invention and its practical application to thereby enable others skilled in the art to best use the invention in various embodiments and with various modifications suited to the particular use contemplated. The scope of the invention is to be defined by the following claims.

I claim:

1. A method for generating x-rays or gamma rays via laser Compton scattering, comprising:

providing a beam-of-laser-pulses with a multi-GHz radio frequency (RF) repetition rate;

utilizing said beam-of-laser-pulses to provide electron micro bunches at said radio frequency (RF), wherein said RF is the operating RF of a linear accelerator that provides said bunches, wherein said bunches are directed to propagate, with radio frequency spacing between successive said bunches, within a first confocal region, wherein said first confocal region is produced by focusing said electron micro bunches; and utilizing said beam-of-laser-pulses to provide interaction-region-laser-pulses at said RF, wherein each interaction-region-laser-pulse of said interaction-region-laser-pulses has a pulse duration within the range of 10 ps to 1 fs, wherein said interaction-region-laser-pulses are directed to propagate, with radio frequency spacing between successive said each interaction-region-laser-pulse, within a second confocal region, wherein said second confocal region is produced by focusing said interaction-region-laser-pulses, wherein said first confocal region and said second confocal region intersect in an interaction region such that said electron micro bunches collide with said interaction-region-laser-pulses to generate incoherent x-rays or gamma-rays via laser Compton scattering, wherein the pulse duration of said each interaction-region-laser-pulse is of the order of the transit time of said each interaction-region-laser-pulse through said second confocal region and wherein the pulse duration of each electron micro bunch of said electron micro bunches is of the order of the transit time of said each interaction-region-laser-pulse through said second confocal region.

2. The method of claim 1, wherein said each interaction-region-laser-pulse collides with a single electron micro bunch of said electron micro bunches in said interaction region.

3. The method of claim 1, wherein said each interaction-region-laser-pulse collides with a single electron micro bunch of said electron micro bunches in said interaction region in a manner such that to first order each electron bunch and said each interaction-region-laser-pulse pair produces the same number of laser Compton photons.

4. The method of claim 1, wherein the bandwidth of a portion of said beam-of-laser-pulses has been increased via self-phase modulation.

5. The method of claim 1, wherein said beam-of-laser-pulses comprises an infrared wavelength, wherein the pulse spacing of said beam-of-laser-pulses and the electron bunch spacing are matched.

6. The method of claim 1, wherein the pulse spacing of said beam-of-laser-pulses and the electron bunch spacing are matched.

7. The method of claim 1, wherein the angle between said first confocal region and said second confocal region is about 90 degrees.

8. The method of claim 1, wherein the angle between said first confocal region and said second confocal region is less than 180 degrees such that said electron micro bunches miss the optic that focuses said laser pulses.

9. A method for generating x-rays or gamma rays via laser Compton scattering, comprising:

producing a first-beam-of-laser-pulses with a multi-GHz radio frequency (RF) repetition rate;

producing a second-beam-of-laser-pulses with said multi-GHz radio frequency (RF) repetition rate;

utilizing said first-beam-of-laser-pulses to provide electron micro bunches at said multi-GHz RF, wherein said RF is the operating RF of a linear accelerator that provides said bunches, wherein said bunches are directed to propagate, with radio frequency spacing between successive said bunches, within a first confocal region, wherein said first confocal region is produced by focusing said electron micro bunches; and utilizing said second-beam-of-laser-pulses to provide interaction-region-laser-pulses at said RF, wherein each interaction-region-laser-pulse of said interaction-region-laser-pulses has a pulse duration within the range of 10 ps to 1 fs, wherein said interaction-region-laser-pulses are directed to propagate, with radio frequency spacing between successive said each interaction-region-laser-pulse, within a second confocal region, wherein said second confocal region is produced by focusing said interaction-region-laser-pulses, wherein said first confocal region and said second confocal region intersect in an interaction region such that said electron micro bunches collide with said interaction-region-laser-pulses to generate incoherent x-rays or gamma-rays via laser Compton scattering, wherein the pulse duration of said each interaction-region-laser-pulse is of the order of the transit time of said each interaction-region-laser-pulse through said second confocal region and wherein the pulse duration of each electron micro bunch of said electron micro bunches is of the order of the transit time of said each interaction-region-laser-pulse through said second confocal region.

10. The method of claim 9, wherein the bandwidth of each pulse of said first-beam-of-laser-pulses and said second-beam-of-laser-pulses has been increased via self-phase modulation.

11. The method of claim 9, wherein the pulse spacing of said interaction-region-laser-pulses and the electron bunch spacing are matched.

12. The method of claim 9, wherein the angle between said first confocal region and said second confocal region is about 90 degrees.

13. The method of claim 9, wherein the angle between said first confocal region and said second confocal region is less than 180 degrees such that said electron micro bunches miss the optic that focuses said laser pulses.

14. An apparatus for generating x-rays or gamma rays via laser Compton scattering, comprising:

a laser for producing a beam-of-laser-pulses with a multi-GHz radio frequency (RF) repetition rate;

a linear accelerator comprising an electron gun, wherein said beam-of-laser-pulses is utilized to trigger said electron gun, wherein said linear accelerator is configured to provide electron micro bunches at said multi-GHz RF;

means for directing said electron micro bunches to propagate, with radio frequency spacing between successive said bunches, within a first confocal region, wherein said first confocal region is produced by focusing said electron micro bunches;

at least one source of interaction-region-laser-pulses, wherein said at least one source is configured to utilize said beam-of-laser-pulses to provide said interaction-region-laser-pulses, wherein each interaction-region-laser-pulse of said interaction-region-laser-pulses has a pulse duration within the range of 10 ps to 1 fs; and means for directing said interaction-region-laser-pulses so that they propagate, with radio frequency spacing between successive said interaction-region-laser-pulses, within a second confocal region, wherein said second confocal region is produced by focusing said interaction-region-laser-pulses, wherein said first confocal region and said second confocal region intersect in an interaction region such that said electron micro bunches will collide with said interaction-region-laser-pulses to generate incoherent x-rays or gamma-rays via laser Compton scattering, wherein the pulse duration of each interaction-region-laser-pulse of said interaction-region-laser-pulses is of the order of the transit time of said each interaction-region-laser-pulse through said second confocal region and wherein the pulse duration of each electron micro bunch of said electron micro bunches is of the order of the transit time of said each interaction-region-laser-pulse through said second confocal region.

15. The apparatus of claim 14, wherein each single said each interaction-region-laser-pulse collides with a corresponding single electron micro bunch of said electron micro bunches in said interaction region.

16. The apparatus of claim 14, wherein each single said interaction-region-laser-pulse collides with a corresponding single electron micro bunch of said electron micro bunches in said interaction region in a manner such that to first order each electron bunch and said interaction-region-laser-pulse pair produces the same number of laser Compton photons.

17. The apparatus of claim 14, wherein said beam-of-laser-pulses comprises an infrared wavelength.

18. The apparatus of claim 17, further comprising at least one means for increasing, via self-phase modulation, the bandwidth of a portion of said beam-of-laser-pulses.

19. The apparatus of claim 14, wherein the angle between said first confocal region and said second confocal region is about 90 degrees.

20. The apparatus of claim 14, wherein the angle between said first confocal region and said second confocal region is less than 180 degrees such that said electron micro bunches miss the optic that focuses said laser pulses.

21. An apparatus for generating x-rays or gamma rays via laser Compton scattering, comprising:

a first laser for producing a first-beam-of-laser-pulses with a multi-GHz radio frequency (RF) repetition rate;

a second laser for producing a second-beam-of-laser-pulses with said multi-GHz radio frequency (RF) repetition rate;

a linear accelerator comprising an electron gun, wherein said first-beam-of-laser-pulses is utilized to trigger said electron gun, wherein said linear accelerator is configured to provide electron micro bunches at said multi-GHz RF;

means for directing said electron micro bunches to propagate, with radio frequency spacing between successive said bunches, within a first confocal region, wherein said first confocal region is produced by focusing said electron micro bunches;

a source of interaction-region-laser-pulses, wherein said source is configured to utilize said second-beam-of-laser-pulses to provide said interaction-region-laser-pulses at said multi-GHz RF, wherein each interaction-region-laser-pulse of said interaction-region-laser-pulses has a pulse duration within the range of 10 ps to 1 fs; and means for directing said interaction-region-laser-pulses so that they propagate, with radio frequency spacing between successive pulses of said interaction-region-laser-pulses, within a second confocal region, wherein said second confocal region is produced by focusing said interaction-region-laser-pulses, wherein said first confocal region and said second confocal region intersect in an interaction region such that said electron micro bunches will collide with said interaction-region-laser-pulses to generate incoherent x-rays or gamma-rays via laser Compton scattering, wherein the pulse duration of each interaction-region-laser-pulse of said interaction-region-laser-pulses is of the order of the transit time of said each interaction-region-laser-pulse through said second confocal region and wherein the pulse duration of each electron micro bunch of said electron micro bunches is of the order of the transit time of each laser pulse of said laser pulses through said second confocal region.

22. The apparatus of claim 21, further comprising at least one means for increasing, via self-phase modulation, the bandwidth of a portion of at least one of said first-beam-of-laser-pulses or said second-beam-of-laser-pulses.

23. The apparatus of claim 21, wherein the angle between said first confocal region and said second confocal region is about 90 degrees.

24. The apparatus of claim 21, wherein the angle between said first confocal region and said second confocal region is less than 180 degrees such that said electron micro bunches miss the optic that focuses said laser pulses.

* * * * *